US012416470B2

(12) United States Patent
Jimenez et al.

(10) Patent No.: US 12,416,470 B2
(45) Date of Patent: Sep. 16, 2025

(54) HOLSTER WITH RETENTION DEVICE AND RELATED METHODS

(71) Applicant: CONCEALMENT EXPRESS LLC, Jacksonville, FL (US)

(72) Inventors: Benedict Jimenez, Jacksonville, FL (US); Sang Cho, Jacksonville, FL (US); Gregory Stukes, Jacksonville, FL (US); Richard Nolan, Jacksonville, FL (US)

(73) Assignee: CONCEALMENT EXPRESS, LLC, Jacksonville, FL (US)

( * ) Notice: Subject to any disclaimer, the term of this patent is extended or adjusted under 35 U.S.C. 154(b) by 0 days.

(21) Appl. No.: 18/818,732

(22) Filed: Aug. 29, 2024

(65) Prior Publication Data

US 2025/0137748 A1 May 1, 2025

Related U.S. Application Data

(63) Continuation-in-part of application No. 29/915,065, filed on Oct. 25, 2023.

(51) Int. Cl.
*F41C 33/02* (2006.01)

(52) U.S. Cl.
CPC ..... *F41C 33/0227* (2013.01)

(58) Field of Classification Search
CPC ..... F41C 33/0227; F41C 33/0263
See application file for complete search history.

(56) References Cited

U.S. PATENT DOCUMENTS 5,150,825 A * 9/1992 Nichols ..... F41C 33/0227 224/242
5,421,497 A * 6/1995 Gilmore ..... F41C 33/045 224/198
5,518,155 A * 5/1996 Gallagher ..... F41C 33/0263 224/244
5,551,611 A * 9/1996 Gilmore ..... F41C 33/045 D3/222
5,931,358 A * 8/1999 Rogers ..... F41C 33/0209 224/245
5,944,239 A * 8/1999 Rogers ..... F41C 33/0209 224/193
7,694,860 B2 4/2010 Clifton, Jr.
7,841,497 B1 * 11/2010 Gregory ..... F41C 33/045 224/912
7,950,553 B2 5/2011 Rassias
8,631,981 B2 1/2014 Zusman
8,851,344 B2 10/2014 Baumann et al.
(Continued)

*Primary Examiner* — Brian D Nash
(74) *Attorney, Agent, or Firm* — Allen, Dyer, Doppelt + Gilchrist, PA

(57) ABSTRACT

A holster is for a firearm and may include a holster body having a proximal wall to be adjacent a user, a distal wall opposite the proximal wall and defining a cavity to receive the firearm, a first longitudinal side coupling the proximal wall and the distal wall, and a second longitudinal side opposite the first longitudinal side and coupling the proximal wall and the distal wall. The holster may include a first retention device having an anchor body coupled between the proximal wall and the distal wall at the second longitudinal side, a flexible arm extending from the anchor body and to press against the firearm when in the cavity, and an adjustable feature carried by the anchor body and configured to bias the flexible arm against the firearm.

18 Claims, 8 Drawing Sheets

(56) References Cited

U.S. PATENT DOCUMENTS

| | | | | |
|---|---|---|---|---|
| 9,383,165 | B2 | 7/2016 | Gregory et al. | |
| 9,494,384 | B2 | 11/2016 | Rogers et al. | |
| 10,302,390 | B2 | 5/2019 | Faifer | |
| 10,712,124 | B2 * | 7/2020 | Courtney | A45F 5/021 |
| 12,078,450 | B2 * | 9/2024 | McKendrick | F41C 33/0236 |
| 2005/0205624 | A1 | 9/2005 | French et al. | |
| 2006/0175366 | A1 | 8/2006 | Dekaise | |
| 2007/0181619 | A1 * | 8/2007 | Seyfert | F41C 33/04 224/912 |
| 2016/0238342 | A1 * | 8/2016 | Tedder | F41C 33/0263 |
| 2018/0164072 | A1 * | 6/2018 | McKendrick | F41C 33/0263 |
| 2018/0202763 | A1 * | 7/2018 | Tedder | F41C 33/0236 |
| 2020/0292272 | A1 * | 9/2020 | Treto | F41C 33/0209 |
| 2020/0408487 | A1 * | 12/2020 | Foster | F41C 33/043 |
| 2022/0099407 | A1 * | 3/2022 | Treto | F41C 33/0227 |
| 2022/0146229 | A1 * | 5/2022 | Evans | F41C 33/0263 |
| 2023/0280129 | A1 * | 9/2023 | Smith | F41C 33/0272 |
| 2023/0417509 | A1 * | 12/2023 | Smith | F41C 33/0236 |
| 2024/0142196 | A1 * | 5/2024 | Kretsinger | F41C 33/0263 |
| 2024/0175658 | A1 * | 5/2024 | Luna | F41C 33/0227 |
| 2024/0247909 | A1 * | 7/2024 | Ivgi | F41C 33/0263 |

* cited by examiner

HOLSTER WITH RETENTION DEVICE AND RELATED METHODS

RELATED APPLICATION

This application is a continuation-in-part of prior filed copending application Ser. No. 29/915,065 filed Oct. 25, 2023, the entire subject matter of which is incorporated herein by reference in its entirety.

TECHNICAL FIELD

The present disclosure relates to the field of firearm accessories, and, more particularly, to a firearm holster and related methods.

BACKGROUND

Firearms have been relevant to American culture since the American Revolution. Indeed, the right to bear firearms was included within the Bill of Rights during the formation of our Constitution. Over the last two centuries, the firearms industry has developed into several silos or specialties: law enforcement and military, sportsman and recreational, and self-defense. Each of these specialties has also developed a large and robust associated firearm accessory industry. Firearm accessories include a large number of accessory types, including holsters, optics, cleaning tools, magazines, and firearms safes, for example.

The firearm holster is typically designed to offer protection to the handgun, secure its retention, and provide ready access to it. Indeed, the firearm holster is one of the more traditional accessories and dates back several centuries. The modern firearm holster industry is quite large and robust. In fact, there are many varying types of holster types, and each holster type has hundreds of available commercial options. For example, firearm holster types may include open-carry holsters, concealed-carry holsters, motor vehicle holsters, and under desk holsters, etc.

In some approaches, a holster may include multiple retention features for retaining the firearm in place. These are known as level II holsters, and typically comprise a friction lock for the firearm and another active retention device, such as a hood for the slide.

SUMMARY

Generally, a holster is for a firearm and may comprise a holster body comprising a proximal wall to be adjacent a user, and a distal wall opposite the proximal wall and defining a cavity therebetween to receive the firearm. The holster body may also include a first longitudinal side coupling the proximal wall and the distal wall, and a second longitudinal side opposite the first longitudinal side and also coupling the proximal wall and the distal wall. The holster may include a first retention device comprising an anchor body coupled between the proximal wall and the distal wall at the second longitudinal side, a flexible arm extending from the anchor body and to press against the firearm when in the cavity, and an adjustable feature carried by the anchor body and configured to bias the flexible arm against the firearm.

In particular, the adjustable feature may comprise an elongate fastener extending through the anchor body and against the flexible arm. The elongate fastener may comprise a threaded shank to threadingly engage a threaded through passageway in the anchor body, and a head coupled to the threaded shank opposite the flexible arm. The anchor body may define first and second through passageways, and each of the proximal wall and the distal wall may comprise first and second openings aligned with the first and second through passageways. The first retention device may comprise first and second fasteners respectively extending though the first and second through passageways, and the first and second openings.

Also, the flexible arm may comprise a first surface abutting the adjustable feature, and a second surface opposite the first surface and abutting the firearm. The first surface may define a raised portion abutting the adjustable feature, and the second surface may define a flat portion abutting the firearm.

In some embodiments, the holster may further comprise a second retention device carried by the holster body adjacent to a rear slide of the firearm. Each of the proximal wall and the distal wall may comprise third and fourth openings at the second longitudinal side, and the holster body may comprise third and fourth fasteners respectively extending through the third and fourth openings. The proximal wall and the distal wall may be integrally coupled at the first longitudinal side.

Another aspect is directed to a method for making a holster for a firearm. The method may include forming a holster body comprising a proximal wall to be adjacent a user, and a distal wall opposite the proximal wall and defining a cavity therebetween to receive the firearm. The holster body may comprise a first longitudinal side coupling the proximal wall and the distal wall, and a second longitudinal side opposite the first longitudinal side and coupling the proximal wall and the distal wall. The method also may include coupling a first retention device to the holster body. The first retention device may comprise an anchor body coupled between the proximal wall and the distal wall at the second longitudinal side, a flexible arm extending from the anchor body and to press against the firearm when in the cavity, and an adjustable feature carried by the anchor body and configured to bias the flexible arm against the firearm.

DETAILED DESCRIPTION

Figure 1:
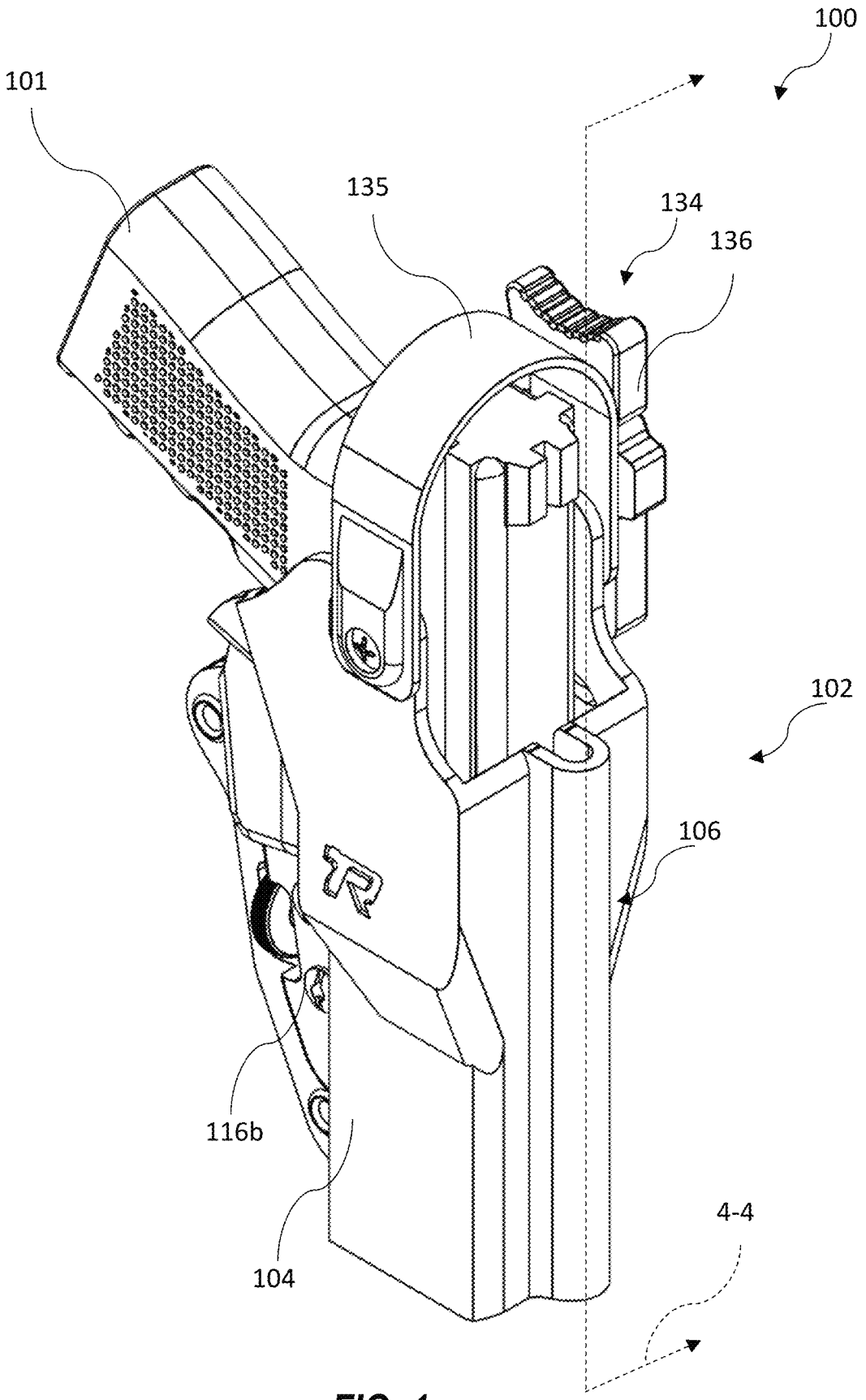
FIG. 1 is a perspective view of a holster with a firearm, according to a first example embodiment of the present disclosure.
Figure 2:
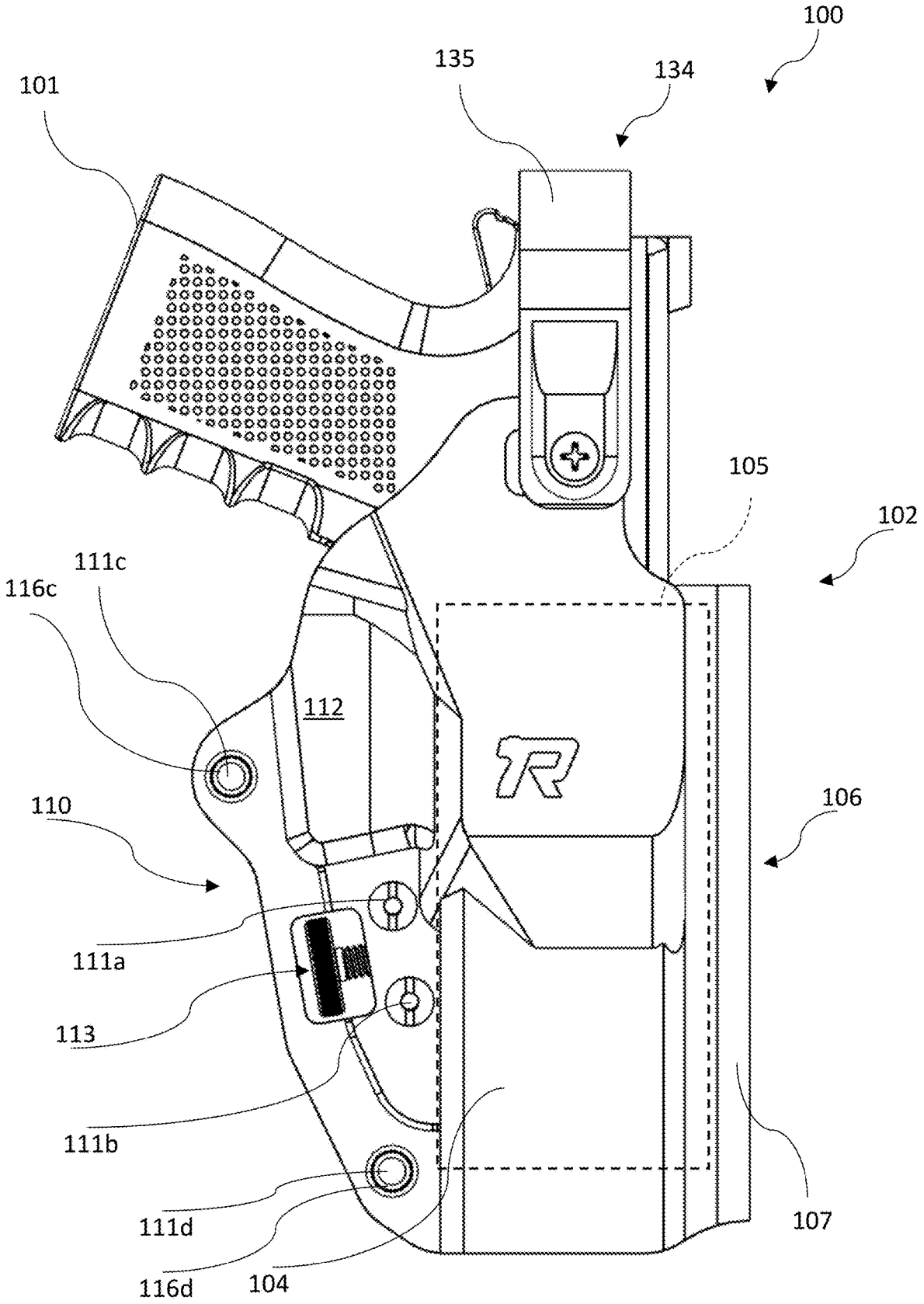
FIG. 2 is a right-side view (distal wall side) of the holster and firearm of FIG. 1.
Figure 3:
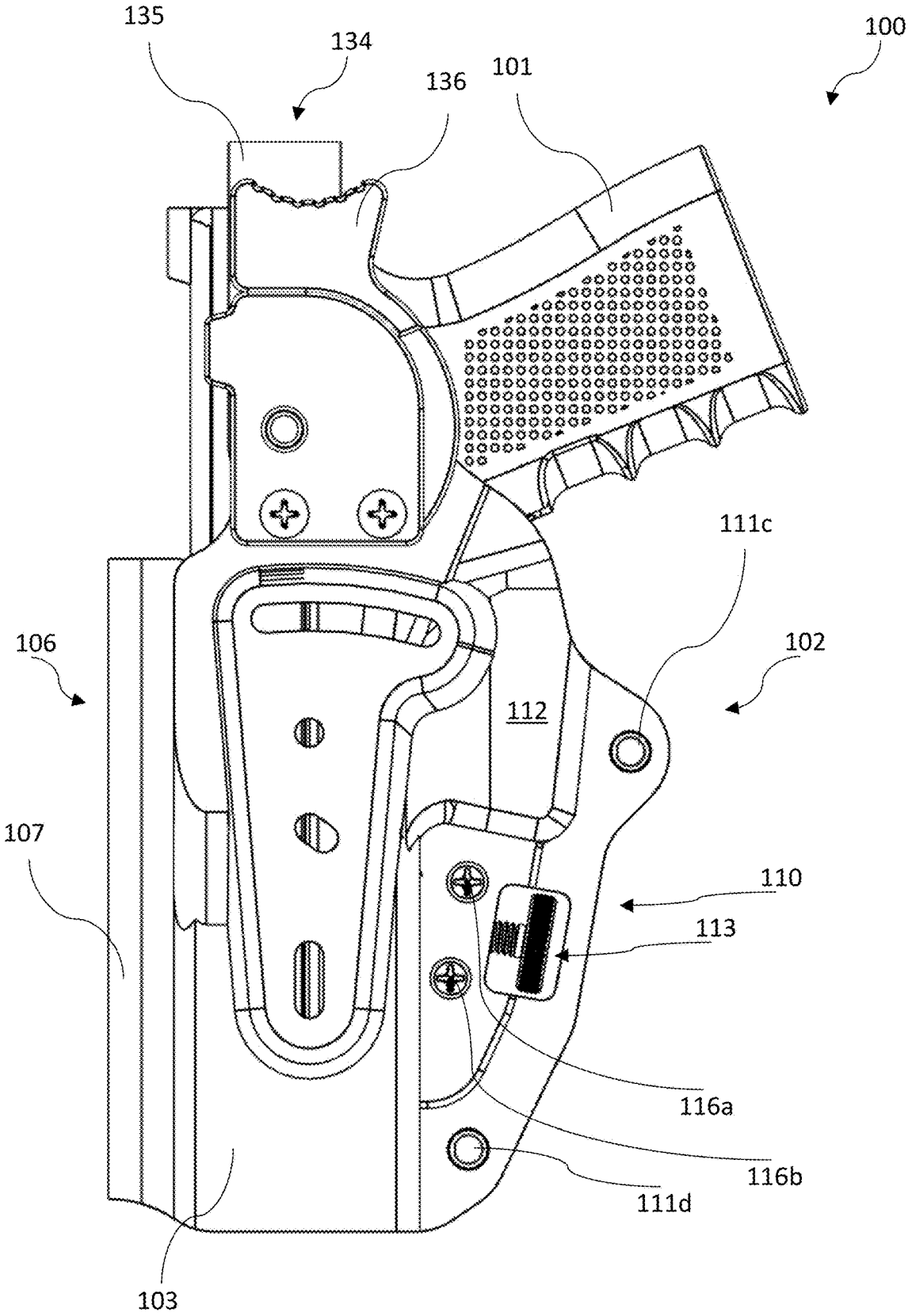
FIG. 3 is a left side view (proximal wall side) of the holster and firearm of FIG. 1.
Figure 4:
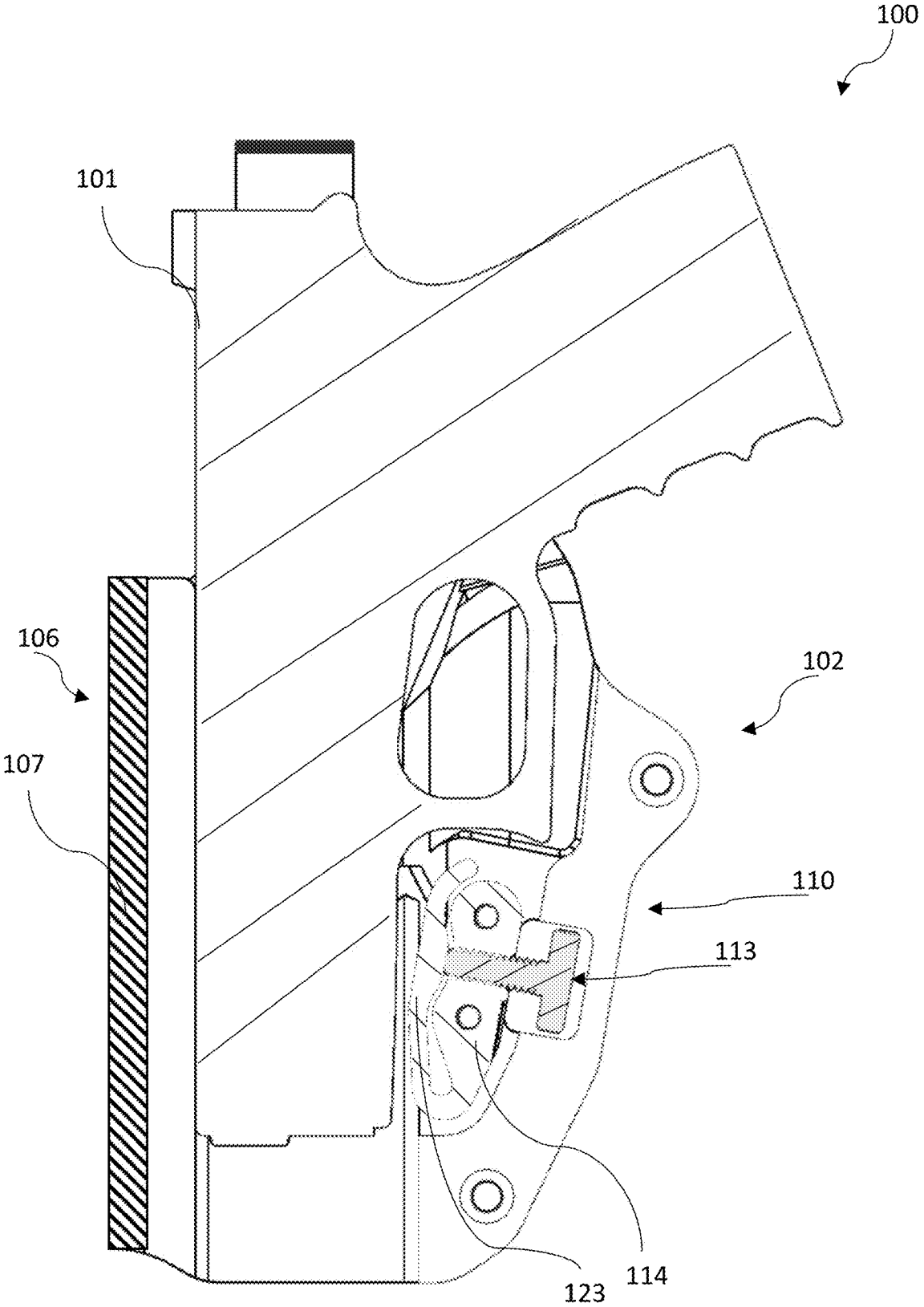
FIG. 4 is a cross-sectional view of the holster and firearm of FIG. 1 along line 4-4.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Referring initially to FIGS. 1-5, a holster 100 for a firearm 101 according to the present disclosure is now described. The holster 100 illustratively includes a holster body 102 comprising a proximal wall 103 to be adjacent a user (i.e., a righthanded holster), and a distal wall 104 opposite the proximal wall and defining a cavity 105 therebetween to receive the firearm. It should be appreciated that the holster 100 may be configured as a lefthanded holster.

The holster body 102 illustratively includes a first longitudinal side 106 coupling the proximal wall 103 and the distal wall 104. In particular, for the illustrated embodiment, the proximal wall 103 and the distal wall 104 are integrally coupled at the first longitudinal side 106. In the illustrated embodiment, the proximal wall 103 and the distal wall 104 are formed from a press mold process (i.e., to fit the given firearm 101) of a sheet of rigid material, for example, a thermoplastic acrylic-polyvinyl chloride polymer such as Kydex, and then folded over to define a U-shaped channel 107 in the first longitudinal side 106. In other embodiments, the proximal wall 103 and the distal wall 104 are integral formed via an injection molding process, thereby removing the U-shaped channel 107. Also, as will be appreciated, the illustrated firearm 101 is merely exemplary, and the teachings of the present disclosure may be applied to any firearm type.

The holster body 102 illustratively includes a second longitudinal side 110 opposite the first longitudinal side 106 and coupling the proximal wall 103 and the distal wall 104. Each of the proximal wall 103 and the distal wall 104 illustratively includes a first opening 111*a*, a second opening 111*b*, a third opening 111*c*, and a fourth opening 111*d* at the second longitudinal side 110. The second longitudinal side 110 illustratively comprises a trigger guard portion 112 to receive a trigger guard of the firearm 101.

The holster 100 illustratively comprises a first retention device 113 comprising an anchor body 114 coupled between the proximal wall 103 and the distal wall 104 at the second longitudinal side 110. In particular, the anchor body 114 defines first and second through passageways 115*a*-115*b* aligned with the first and second openings 111*a*-111*b* of each of the proximal wall 103 and the distal wall 104.

The first retention device 113 illustratively comprises first and second fasteners 116*a*-116*b* (e.g., threaded holster screws having a threaded fastener and a reversed threaded flanged base) respectively extending though the first and second through passageways 115*a*-115*b* and the first and second openings 111*a*-111*b*. The holster body 102 illustratively includes third and fourth fasteners 116*c*-116*d* (e.g., threaded holster screws having a threaded fastener and a reversed threaded flanged base or interfacing grommets) respectively extending through the third and fourth openings 111*c*-111*d* of each of the proximal wall 103 and the distal wall 104 to couple respective ends together and define the second longitudinal side 110.

Figure 6:
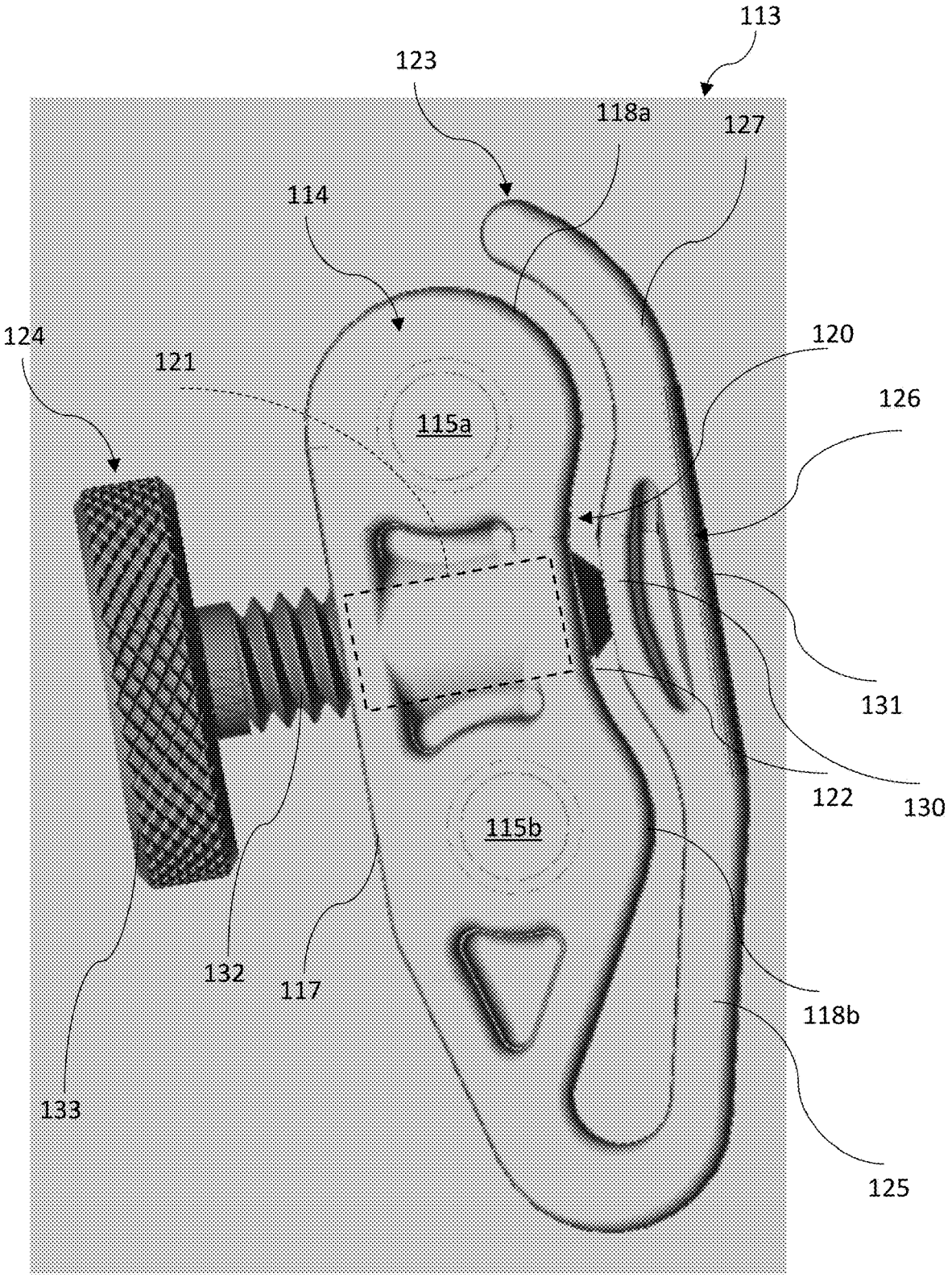
FIG. 6 is a right-side view of a first retention device from the holster of FIG. 1.

Referring now additionally to FIG. 6, the anchor body 114 illustratively includes a first body surface 117 facing outward and being substantially flat, a second body surface 120 facing inward towards the firearm 101, and a threaded through passageway 121 extending between the first body surface and the second body surface. The second body surface 120 illustratively includes first and second raised curved surfaces 118*a*-118*b* flanking the threaded through passageway 121, and a recessed surface 122 between the first and second raised curved surfaces. The threaded through passageway 121 opens up at the recessed surface 122.

The first retention device 113 illustratively comprises a flexible arm 123 extending from the anchor body 114 and to press against the firearm 101 when in the cavity 105, and an adjustable feature 124 carried by the anchor body and configured to bias the flexible arm against the firearm. The flexible arm 123 illustratively turns back on itself (i.e., a substantially 180° turn) and comprises a proximal portion 125 being flat, a medial portion 126 extending from the proximal portion, and a distal portion 127 extending from the medial portion and curving inwardly and in tandem with curved surfaces of the anchor body 114. Also, the medial portion 126 illustratively includes a first arm surface 130 abutting the adjustable feature 124, and a second arm surface 131 opposite the first surface and abutting the firearm 101. The first arm surface 130 defines a raised portion abutting the adjustable feature 124 and being received by the recessed surface 122. The second arm surface 131 defines a flat portion abutting the firearm 101.

In the illustrated embodiment, the adjustable feature 124 comprises an elongate fastener 132 extending through the anchor body 114 and against the flexible arm 123. The elongate fastener 132 comprises a threaded shank to threadingly engage the threaded through passageway 121 in the anchor body, and a head 133 coupled to the threaded shank opposite the flexible arm 123. The head 133 illustratively comprises a hand screw interface for permitting easy adjustment by the user.

Figure 5:
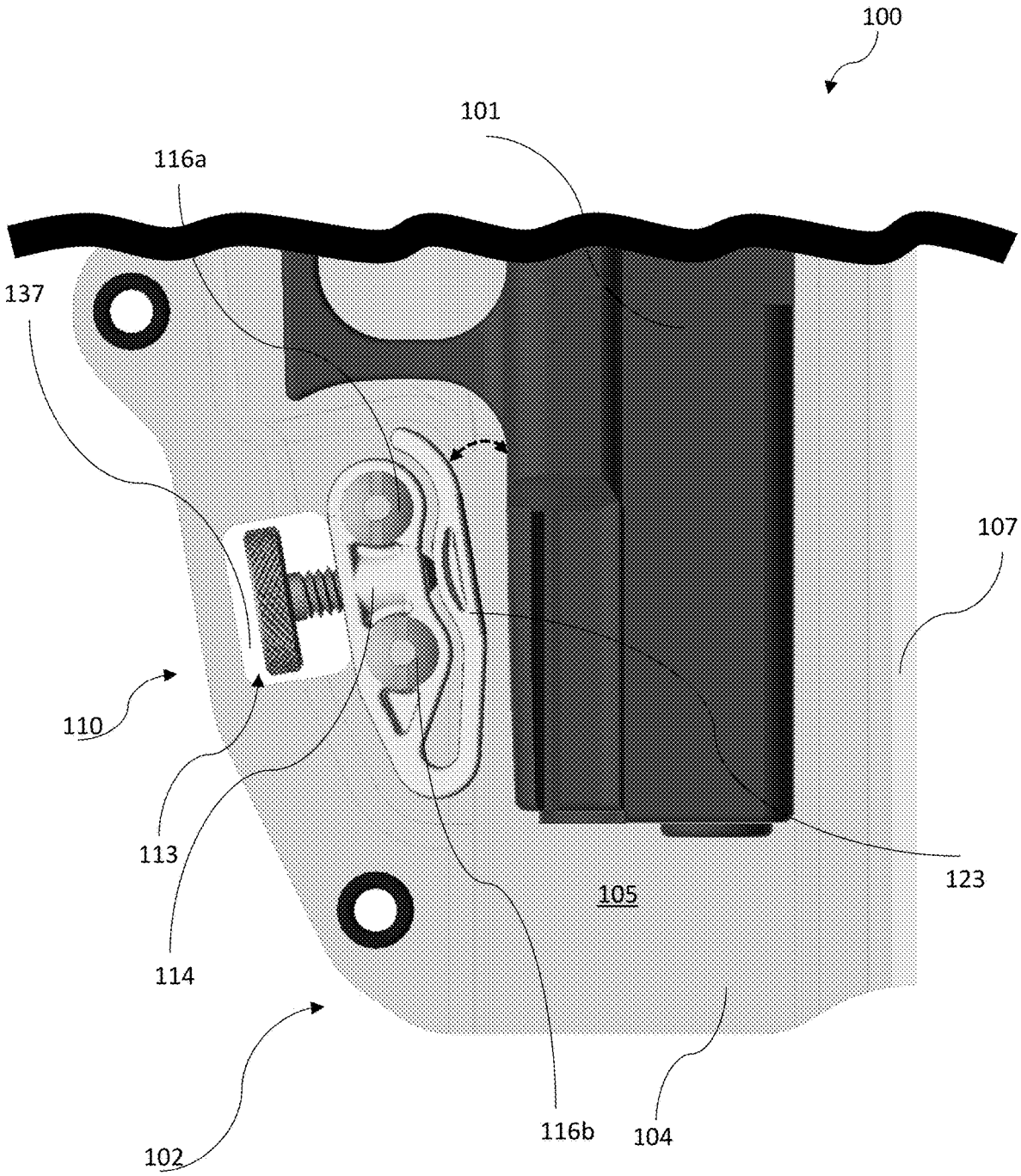
FIG. 5 is an enlarged right-side view of the holster and firearm of FIG. 1 with the distal wall being transparent.

As perhaps best seen in FIG. 5 with the dashed arrow and as will be appreciated, as the elongate fastener 132 is positioned longitudinally inward against the flexible arm 123, the friction retention against the firearm 101 is increased. Conversely, as the elongate fastener 132 is positioned longitudinally outward and away from the flexible arm 123, the friction retention against the firearm 101 is decreased.

Further, the holster 100 illustratively includes a second retention device 134 carried by the holster body 102 adjacent to a rear slide of the firearm 101. In the illustrated embodiment, the second retention device 134 comprises a pivoting hood 135 for retaining a rear slide portion of the firearm 101, and a thumb lock release lever 136. As perhaps best seen in FIG. 5, the proximal wall 103 and the distal wall 104 define an opening 137 for receiving the head 133 and permitting easy access for the user.

Another aspect is directed to a method for making a holster 100 for a firearm 101. The method includes forming a holster body 102 comprising a proximal wall 103 to be adjacent a user, a distal wall 104 opposite the proximal wall and defining a cavity 105 therebetween to receive the firearm, a first longitudinal side 106 coupling the proximal wall and the distal wall, and a second longitudinal side 110 opposite the first longitudinal side and coupling the proximal wall and the distal wall. The method also includes coupling a first retention device 113 to the holster body 102. The first retention device 113 comprises an anchor body 114 coupled between the proximal wall 103 and the distal wall 104 at the second longitudinal side 110, a flexible arm 123 extending from the anchor body and to press against the firearm 101 when in the cavity 105, and an adjustable feature 124 carried by the anchor body and configured to bias the flexible arm against the firearm.

Figure 7:
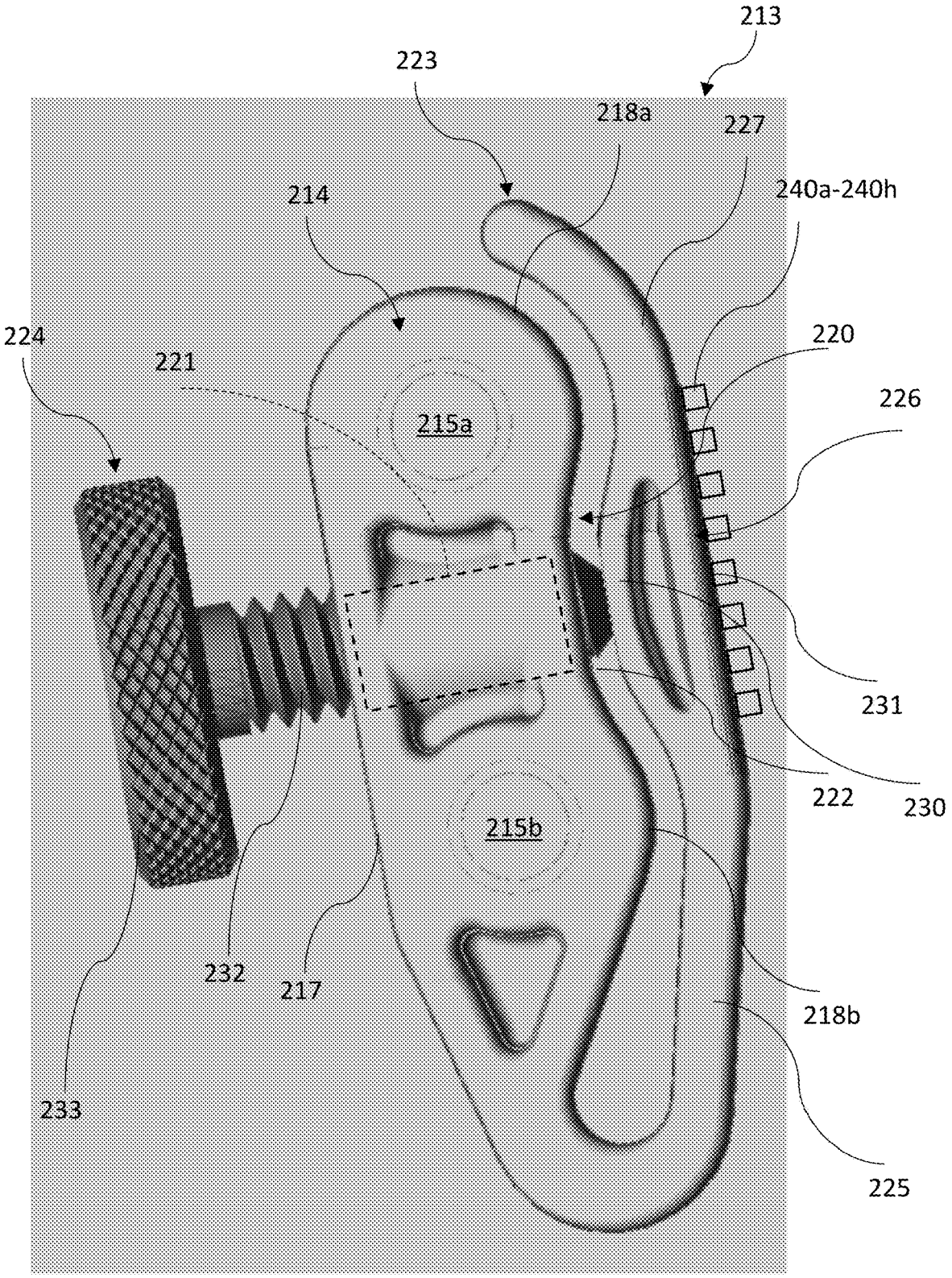
FIG. 7 is a right-side view of a first retention device from a holster, according to a second example embodiment of the present disclosure.

Referring now additionally to FIG. 7, another embodiment of the retention device 213 is now described. In this embodiment of the retention device 213, those elements already discussed above with respect to FIGS. 1-6 are incremented by 100 and most require no further discussion herein. This embodiment differs from the previous embodiment in that this retention device 213 illustratively includes the second arm surface 231 defining a ridged portion abutting the firearm (not shown) and comprising a plurality of ridges 240*a*-240*h* to enhance a friction lock on the firearm.

Figure 8:
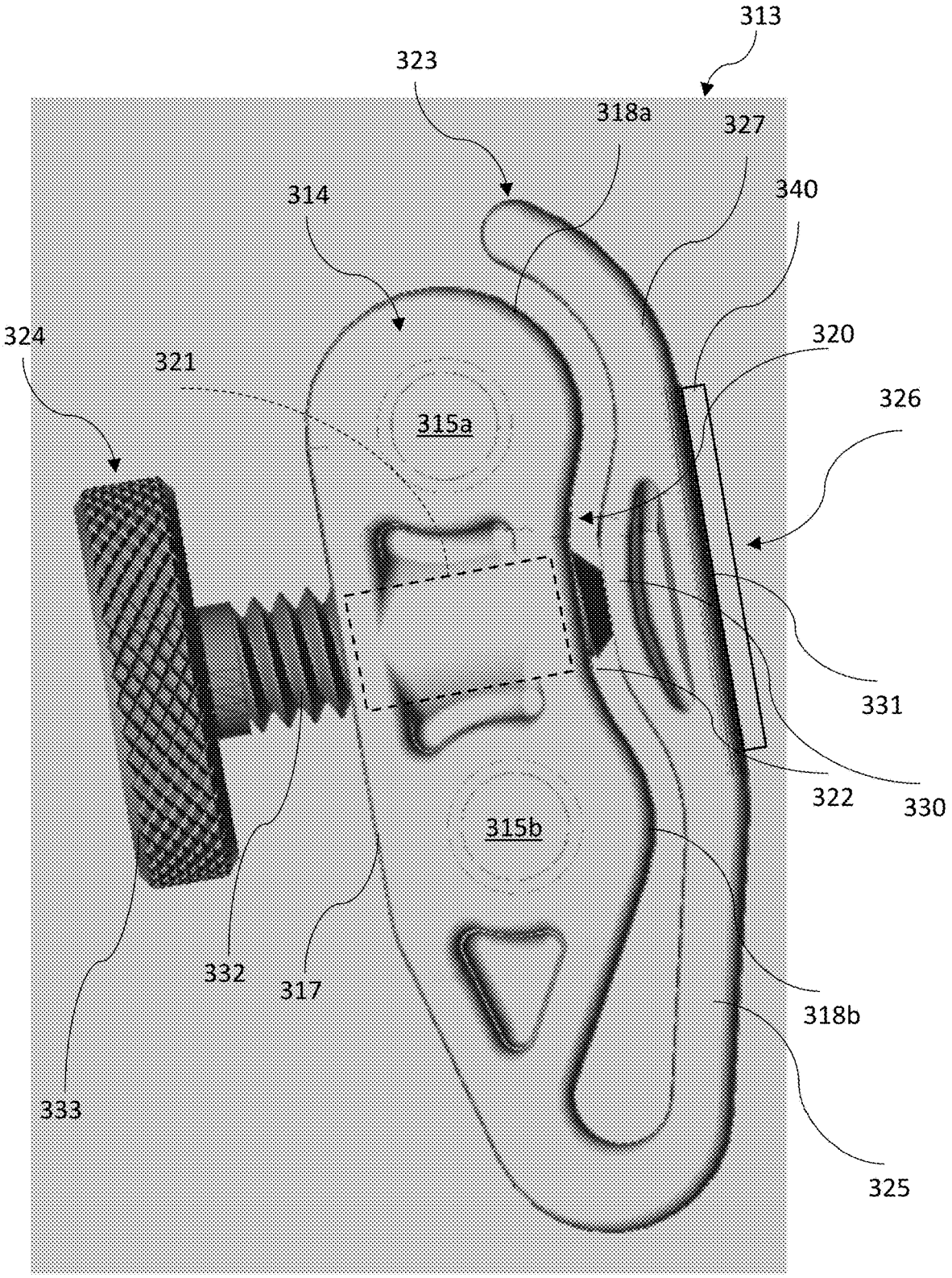
FIG. 8 is a right-side view of a first retention device from a holster, according to a third example embodiment of the present disclosure.

Referring now additionally to FIG. 8, another embodiment of the retention device 313 is now described. In this embodiment of the retention device 313, those elements already discussed above with respect to FIGS. 1-6 are incremented by 200 and most require no further discussion herein. This embodiment differs from the previous embodiment in that this retention device 313 illustratively includes the second arm surface 331, and a friction pad 340 coupled to the second arm surface 331 to enhance a friction lock on the firearm. In some embodiments, the friction pad 340 may comprise a high friction (i.e., sticky) material, such as rubber, with an adhesive backing.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A holster for a firearm, the holster comprising:
- a holster body comprising
  - a proximal wall to be adjacent a user,
  - a distal wall opposite the proximal wall and defining a cavity therebetween to receive the firearm,
  - a first longitudinal side coupling the proximal wall and the distal wall, and
  - a second longitudinal side opposite the first longitudinal side; and
- a first retention device comprising
  - an anchor body coupled between the proximal wall and the distal wall at the second longitudinal side,
  - a flexible arm extending from the anchor body and to press against the firearm when in the cavity, and
  - an adjustable feature carried by the anchor body and configured to bias the flexible arm against the firearm, the flexible arm comprising a first surface abutting the adjustable feature, and a second surface opposite the first surface and abutting the firearm, the first surface defining a raised portion abutting the adjustable feature, the second surface defining a flat portion abutting the firearm.

2. The holster of claim 1 wherein the adjustable feature comprises an elongate fastener extending through the anchor body and against the flexible arm.

3. The holster of claim 2 wherein the elongate fastener comprises a threaded shank to threadingly engage a threaded through passageway in the anchor body, and a head coupled to the threaded shank opposite the flexible arm.

4. The holster of claim 1 wherein the anchor body defines first and second through passageways; and wherein each of the proximal wall and the distal wall comprises first and second openings aligned with the first and second through passageways.

5. The holster of claim 4 wherein the first retention device comprises first and second fasteners respectively extending though the first and second through passageways, and the first and second openings.

6. The holster of claim 1 further comprising a second retention device carried by the holster body adjacent to a rear slide of the firearm.

7. The holster of claim 1 wherein each of the proximal wall and the distal wall comprises third and fourth openings at the second longitudinal side; and wherein the holster body comprises third and fourth fasteners respectively extending through the third and fourth openings.

8. The holster of claim 1 wherein the proximal wall and the distal wall are integrally coupled at the first longitudinal side.

9. A method for making a holster for a firearm, the method comprising:
- forming a holster body comprising
  - a proximal wall to be adjacent a user,
  - a distal wall opposite the proximal wall and defining a cavity therebetween to receive the firearm,
  - a first longitudinal side coupling the proximal wall and the distal wall, and
  - a second longitudinal side opposite the first longitudinal side; and
- coupling the proximal wall and the distal wall together using a first retention device, the first retention device comprising
  - an anchor body coupled between the proximal wall and the distal wall at the second longitudinal side,
  - a flexible arm extending from the anchor body and to press against the firearm when in the cavity, and
  - an adjustable feature carried by the anchor body and configured to bias the flexible arm against the firearm, the flexible arm comprising a first surface abutting the adjustable feature, and a second surface opposite the first surface and abutting the firearm, the first surface defining a raised portion abutting the adjustable feature, the second surface defining a flat portion abutting the firearm.

10. The method of claim 9 wherein the adjustable feature comprises an elongate fastener extending through the anchor body and against the flexible arm.

11. The method of claim 10 wherein the elongate fastener comprises a threaded shank to threadingly engage a threaded through passageway in the anchor body, and a head coupled to the threaded shank opposite the flexible arm.

12. A holster for a firearm, the holster comprising:
- a holster body comprising
  - a proximal wall to be adjacent a user,
  - a distal wall opposite the proximal wall and defining a cavity therebetween to receive the firearm,
  - a first longitudinal side coupling the proximal wall and the distal wall,
  - a second longitudinal side opposite the first longitudinal side, each of the proximal wall and the distal wall comprising third and fourth openings at the second longitudinal side, and
  - third and fourth fasteners respectively extending through the third and fourth openings; and
- a first retention device comprising
  - an anchor body coupled between the proximal wall and the distal wall at the second longitudinal side, a flexible arm extending from the anchor body and to press against the firearm when in the cavity, and an adjustable feature carried by the anchor body and configured to bias the flexible arm against the firearm.

13. The holster of claim 12 wherein the adjustable feature comprises an elongate fastener extending through the anchor body and against the flexible arm.

14. The holster of claim 13 wherein the elongate fastener comprises a threaded shank to threadingly engage a threaded through passageway in the anchor body, and a head coupled to the threaded shank opposite the flexible arm.

15. The holster of claim 12 wherein the anchor body defines first and second through passageways; and wherein each of the proximal wall and the distal wall comprises first and second openings aligned with the first and second through passageways.

16. The holster of claim 15 wherein the first retention device comprises first and second fasteners respectively extending though the first and second through passageways, and the first and second openings.

17. The holster of claim 12 further comprising a second retention device carried by the holster body adjacent to a rear slide of the firearm.

18. The holster of claim 12 wherein the proximal wall and the distal wall are integrally coupled at the first longitudinal side.

* * * * *